US007594419B2

(12) United States Patent
Robbins

(10) Patent No.: US 7,594,419 B2
(45) Date of Patent: Sep. 29, 2009

(54) THERMAL CONTROL EXTRUSION PRESS CONTAINER

(76) Inventor: Paul Robbins, 446 Reach Streat, Port Perry, ON (CA) L9L 1X1

( * ) Notice: Subject to any disclaimer, the term of this patent is extended or adjusted under 35 U.S.C. 154(b) by 0 days.

(21) Appl. No.: 11/837,188

(22) Filed: Aug. 10, 2007

(65) Prior Publication Data

US 2008/0022745 A1 Jan. 31, 2008

Related U.S. Application Data

(63) Continuation of application No. 11/132,993, filed on May 19, 2005, now Pat. No. 7,272,967.

(30) Foreign Application Priority Data

May 21, 2004 (CA) ..... 2468006

(51) Int. Cl.
*B21C 27/00* (2006.01)

(52) U.S. Cl. ..... 72/272; 72/342.7

(58) Field of Classification Search ..... 72/17.2, 72/20.1, 253.1, 272, 342.7, 342.8, 342.92, 72/364

See application file for complete search history.

(56) References Cited

U.S. PATENT DOCUMENTS 1,715,936 A 6/1929 Madden
2,075,622 A * 3/1937 Nehlsen ..... 219/602
2,820,132 A * 1/1958 Krause ..... 219/422
2,853,590 A * 9/1958 Zandel et al. ..... 219/422
3,042,195 A * 7/1962 Muller ..... 72/272
3,063,560 A * 11/1962 Edgecombe ..... 72/468
3,161,756 A * 12/1964 Haverkamp et al. ..... 219/422
3,360,975 A * 1/1968 Edgecombe ..... 72/272
3,385,953 A * 5/1968 Henneberger ..... 219/390
3,478,562 A * 11/1969 Groos ..... 72/272
3,531,624 A * 9/1970 Henneberger ..... 219/422
3,724,253 A * 4/1973 Revell et al. ..... 72/253.1
4,032,290 A 6/1977 Soderlund et al.
4,308,742 A * 1/1982 Harrison et al. ..... 72/253.1
4,703,642 A * 11/1987 Wagner et al. ..... 72/269
6,637,250 B2 10/2003 Plata et al.

FOREIGN PATENT DOCUMENTS

GB 2070997 * 9/1981
JP 3-133512 * 6/1991

* cited by examiner

*Primary Examiner*—Edward Tolan
(74) *Attorney, Agent, or Firm*—Young Basile Hanlon & MacFarlane P.C.

(57) ABSTRACT

A subliner for use in a metal extrusion press, the subliner comprising an elongate annular body having an outer surface dimensioned for placement within an outer mantle, and an inner surface dimensioned to receive an inner liner. The subliner further comprises at least one heating element positioned longitudinally between the outer and inner surfaces of the elongate annular body for providing beat in at least one selected region of the subliner, in close proximity to the inner liner.

39 Claims, 4 Drawing Sheets

THERMAL CONTROL EXTRUSION PRESS CONTAINER

This application is a continuation of application Ser. No. 11/132,993 filed May 19, 2005, now U.S. Pat. No. 7,272,967.

FIELD OF THE INVENTION

The present invention relates to a subliner containing heating elements for use in a metal extrusion press.

BACKGROUND OF THE INVENTION

In order to attain cost-saving efficiency and productivity in metal extrusion technologies, it is important to achieve thermal alignment of the extrusion press. Thermal alignment is the control and maintenance of optimal running temperature of the various extrusion press components. It ensures that the flow of extrudable material is uniform and enables the press operator to press at maximum speed, with less waste. A number of factors must be considered when assessing the thermal alignment of an extrusion press. For example, the billet of extrudable material must be completely at the optimum operating temperature in order to assure uniform flow rates over the cross-sectional area of the billet. The temperature of the liner in the extrusion container must also serve to preserve and not interfere with the temperature profile of the billet contained therein (i.e. uniform or tapered).

Achieving thermal alignment is generally a challenge to a press operator. During extrusion, the top of the extrusion press container usually becomes hotter than the bottom. Although conduction is the principal method of heat transfer within the container, radiant heat lost from the bottom surface of the container rises inside the container housing, leading to an increase in temperature at the top. As the front and rear of the container are generally exposed, they will lose more heat than the center. This may result in the center section of the container being hotter than the ends. As well, the temperature at the die end of the container tends to be slightly higher compared to the rain end, as the billet heats it for a longer period of time. These temperature variations in the container affect the temperature of the finer contained therein, this in turn affecting the temperature of the billet of extrudable material. While the total flow of extrudable material from the press depends solely on the speed of the ram, flow rates from hotter sections of the billet will be faster compared to flow rates from cooler sections. The run-out variance across the cross-sectional profile of a billet can be as great as 1% for every 5° C. difference in temperature. This can adversely affect the shape of the profile of the extruded product.

In view of these multiple interactions between the container, the liner and the billet, the overall extrusion system requires a dynamic means to control and maintain temperature and preselected temperature profiles.

One method known in the art is to provide heating elements in the container housing, surrounding the mantle. Examples of this technology include U.S. Pat. Nos. 3,385,953 and 3,531,624 which teach the use of multiple arcuate heating coils. Another example is U.S. Pat. No. 3,113,676 which teaches a more complete circumferential wrapping about the mantle. This means of heating an extrusion press container, which is based largely on convection, presents certain challenges. First, since the heating elements are located around the container, in essence as a "blanket", they are considerably distant from the temperature sensors or thermocouples generally located near the liner. In a large container, this distance could exceed 30 cm. As a result, in addition to losing a considerable amount of heat to the container holder and surrounding environment, the response time to measured temperature conditions is unavoidably slow. Second, the heating elements used generally have a sheath temperature of 705 to 760° C. In maintaining a temperature of 425 to 480° C. at the liner, the temperature near the surface of the mantle can easily reach more than 705° C. This is well in excess of the annealing temperature of 540° C. for the 4340 steel generally used to manufacture this component. These factors increase the risk of annealing and softening of the mantle, leading to a deformation of the liner and loss of physical alignment of the extrusion press. The overheating and softening of the mantle also increases the risk of liner fracture under full ram pressure. In addition, annealing of the mantle and deformation of the liner may lead to the accumulation of impurities, with subsequent contamination of the product. In extreme cases, mantle fracture is also a possibility. Furthermore, if the outside of the container becomes considerably hotter than the liner, the interference fit between the liner and the mantle may be adversely affected. This would result in the failure of the shrink fit causing the liner to loosen and slip.

Another method of controlling the temperature of the container is to position the heat source inside the container itself. A variety of configurations for this technology are known. These configurations include longitudinally oriented elements (U.S. Pat. Nos. 2,075,622 and 3,161,756), spirally oriented elements (U.S. Pat. No. 2,792,482), circumferentially oriented elements (U.S. Pat. No. 2,820,132) as well as radially oriented elements (U.S. Pat. No. 2,853,590). Although this method is an improvement compared to the "blanket" heaters discussed above, conductive and radiant heat is still being applied to the core of the mantle, with the temperature sensors being spatially distant on the liner. Depending on the location of the heating elements in the container, the response time to temperature changes in the liner can be far from immediate.

In general, when the extrusion press is run continuously, little more than minor temperature adjustments should be necessary to maintain thermal alignment of the press. When the press has been stopped, however, the container must be preheated to minimize "chilling", or thermal shock to the billet on start-up. Preheating the container in a manner that is both quick and efficient, in a manner that does not adversely affect the container itself, as well as maintaining operating temperature during brief stops can be difficult. In general, the operator should aim to reduce the likelihood of thermal fatigue in the container by implementing means to minimize the temperature difference between the mantle and liner during both extrusion and down periods.

SUMMARY OF THE INVENTION

Broadly stated, the present invention provides a subliner for use in a metal extrusion press, the subliner being configured for placement between the mantle and the liner, the subliner being further configured to receive at least one longitudinally oriented heating elements for heating the subliner as required to achieve and maintain thermal alignment of the extrusion press.

In accordance with one aspect of the present invention, there is provided a subliner for use in a metal extrusion press, said subliner comprising:

an elongate annular body having an outer surface dimensioned for placement within an outer mantle, and an inner surface dimensioned to receive an inner liner, said subliner further comprising at least one heating element positioned longitudinally between said outer and inner surfaces of said elongate annular body for providing heat in at least one selected region of said subliner, in close proximity to said inner liner.

In accordance with another aspect of the present invention, there is provided a container for use in an extrusion press for extruding an extrudable metal, said container comprising:

an outer mantle configured for connecting to an extrusion press;

an inner liner; and a subliner comprising an elongate annular body having an outer surface dimensioned for placement within said outer mantle, and an inner surface dimensioned to receive said inner liner, said subliner further comprising at least one heating element positioned longitudinally between said outer and inner surfaces of said elongate annular body for providing heat in at least one selected region of said subliner, in close proximity to said inner liner.

In accordance with yet another aspect of the present invention, there is provided a method of delivering heat to a container in close proximity to an inner liner contained therein, comprising heating a subliner positioned between an outer mantle and said inner linier of said container, said subliner comprising at least one longitudinally oriented heating element permitting heat to be delivered to at least one select region of said inner liner without overheating said outer mantle.

The present invention provides advantages in that both temperature sensors and heating elements are located in a subliner, in very close proximity to the liner. This close proximity enables an almost immediate response to changes in extrusion process temperature, allowing the operator much better control of the flow of extrudable material as it leaves the container and enters the profile die.

The present invention also provides advantages in that since the heating of the container is now removed from the mantle itself, the likelihood of annealing and softening of the mantle is considerably reduced. The above noted close proximity of the temperature sensor, heating elements and liner reduce the risk of dangerous overheating, since the heat source is immediately adjacent the sensors used to monitor the liner temperature. This reduces the likelihood of thermal fatigue in the container resulting from major temperature differences between the mantle and liner during both extrusion and down times. This also presents considerable cost savings as the liner is heated as opposed to the container.

Further advantages of the present invention include immediate and continually controlled adjustment of the temperature in at least the front, rear, top and bottom zones of the container to address temperature variations due to heat loss, as well as to maintain preselected temperature profiles in the billet contained therein. Further, the high-strength steel subliner strengthens the overall container, making for a more robust design.

BRIEF DESCRIPTION OF THE DRAWINGS

An embodiment of the present invention will now be described more fully with reference to the accompanying drawings in which.

DETAILED DESCRIPTION OF THE INVENTION

Various aspects of the present invention are described in detail where it is appreciated that the technology may find application for use in a metal extrusion press, particularly for aluminum extrusion.

Figure 1:
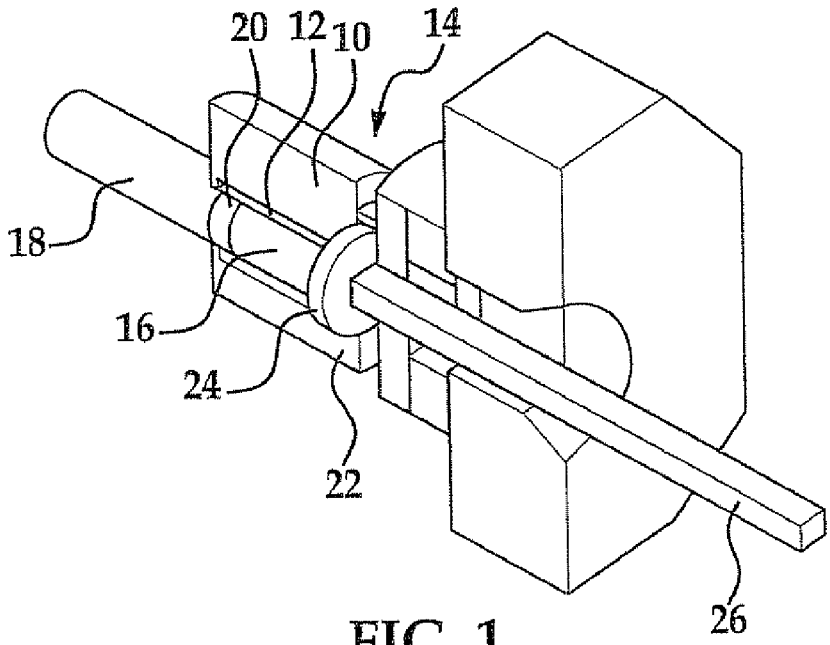
FIG. 1 is a simplified perspective view of a metal extrusion press suitable for the present invention.

As a general introduction to the type of apparatus in which the subliner of the present invention may be used, FIG. 1 shows a simplified standard arrangement of a metal extrusion press. The extrusion press generally comprises, but is not limited to, a mantle 10, with a tubular liner 12 which defines the container 14 for a billet 16. The extruding equipment also includes an extrusion ram 18, the end of which abuts a dummy block 20, which in turn abuts the billet 16. At the extruding end 22 of the apparatus, an extrusion die 24 is provided. Once the billet 16 is heated to the optimal extrusion temperature (i.e. 800-900° F. for aluminum), it is placed within the container 14 as surrounded by liner 12. The extrusion ram 18 and abutting dummy block 20 are advanced, thereby advancing the billet 16 towards the extrusion die 24. Under the pressure exerted by the advancing extrusion ram 18 and dummy block 20, the billet 16 is extruded through the profile provided in the extrusion die 24 until all of or most of the billet material is pushed out of the container 14, resulting in the extruded product 26.

As discussed with respect to the background of the invention, maintaining thermal alignment of the extrusion press is necessary for cost-saving efficiency and productivity in metal extrusion technologies. Thermal alignment ensures that the flow of extrudable material is uniform and enables tile press operator to press at maximum speed, with less waste. Optimal billet temperature can only be maintained if the container can immediately correct any change in the liner temperature during the extrusion process, when and where it occurs. Often all that is required is the addition of relatively small amounts of heat to areas that are deficient. It has been determined that for effective temperature control, the container should have at least four separate heating zones: top, bottom, front and rear. To enhance response time to measured temperature deficits, the heat source and temperature controlling sensors should be close to the need, that is close to the liner.

The present invention provides an effective means to improve temperature control of tie extrusion process, in particular of the liner, while reducing the risk of annealing and softening of the mantle.

Figure 2:
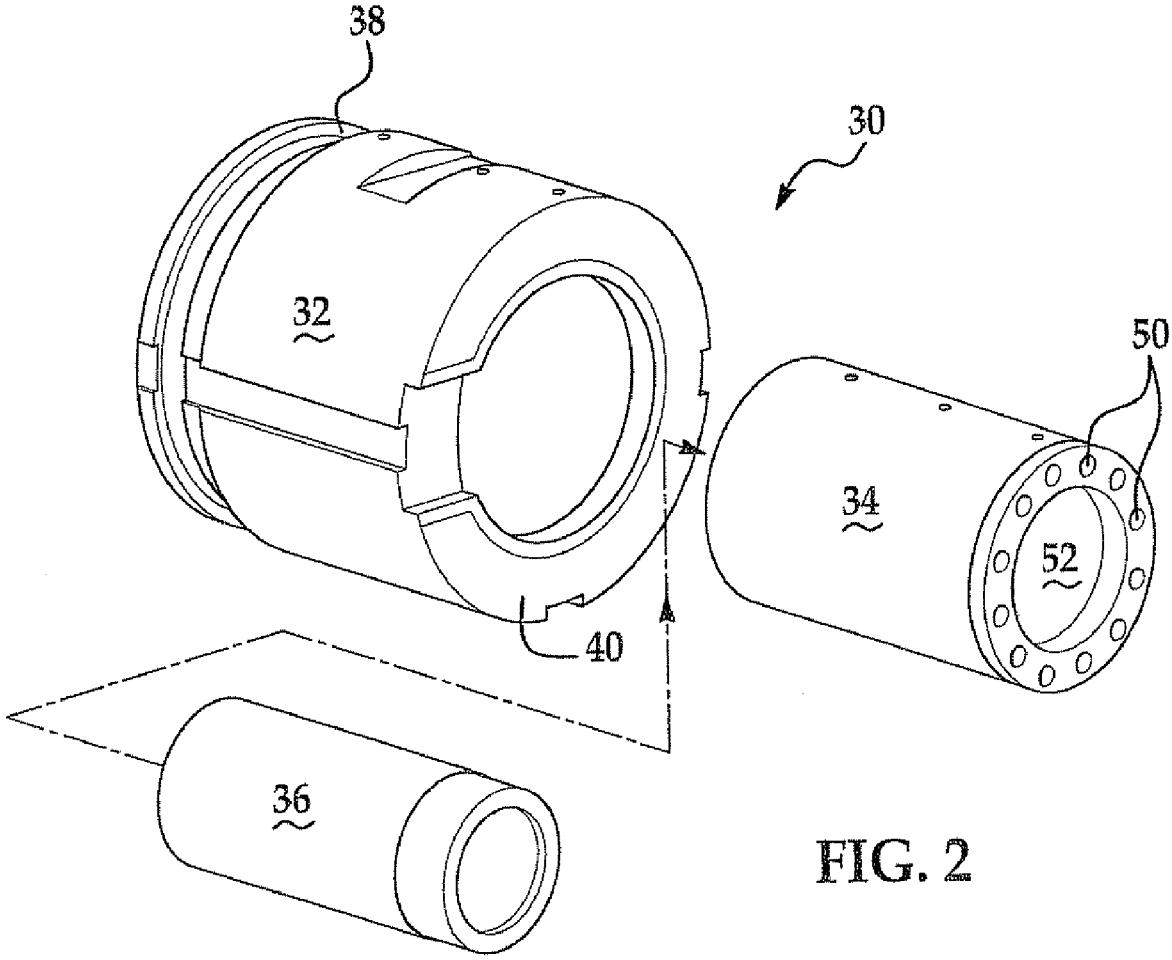
FIG. 2 is an exploded view showing placement of the subliner of the present invention in a container used for metal extrusion.

Shown in FIG. 2 is an exploded view of a container incorporating the present invention. The container, generally represented as 30, comprises three concentrically aligned and nested components consisting of an outer mantle 32, an intermediate subliner 34 and a inner liner 36, each being shrunk-fit together to form the assembled container shown in FIG. 3. In the embodiment shown, the container 30 is configured at the die end 38 and along the side sections thereof in a manner familiar in the art to couple the container 30 to an extrusion press (not shown). At the ram end 40, provided is a channel 42 for passage of bus lines (not shown) described in greater detail below. The ram end 40 is further configured with a recess 44 for placement of cover plates to protect the bus lines contained therein. With respect to the heating zones of the container, or more specifically of the subliner, FIG. 4 shows these general areas as top zone 45*a*, bottom zone 45*b*, front zone 45*c* and rear zone 45*d*.

To achieve a more favorable stress distribution in the container 30, a reduced shrink fit interference compared to conventional prior art containers is adopted. For example, a prior art container would normally have an a shrink fit interference of 0.25%; the shrink fit interference of a container incorporating the subliner of the current invention should not be greater than about 0.2%.

Figure 3:
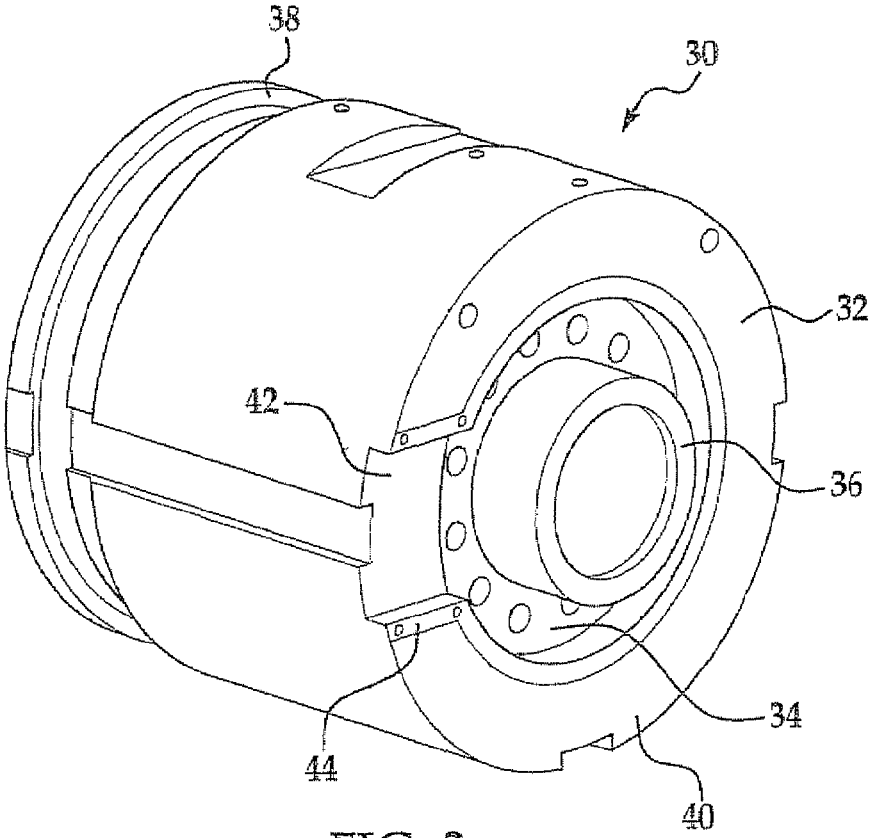
FIG. 3 is a perspective view showing an assembled container of the present invention.
Figure 4:
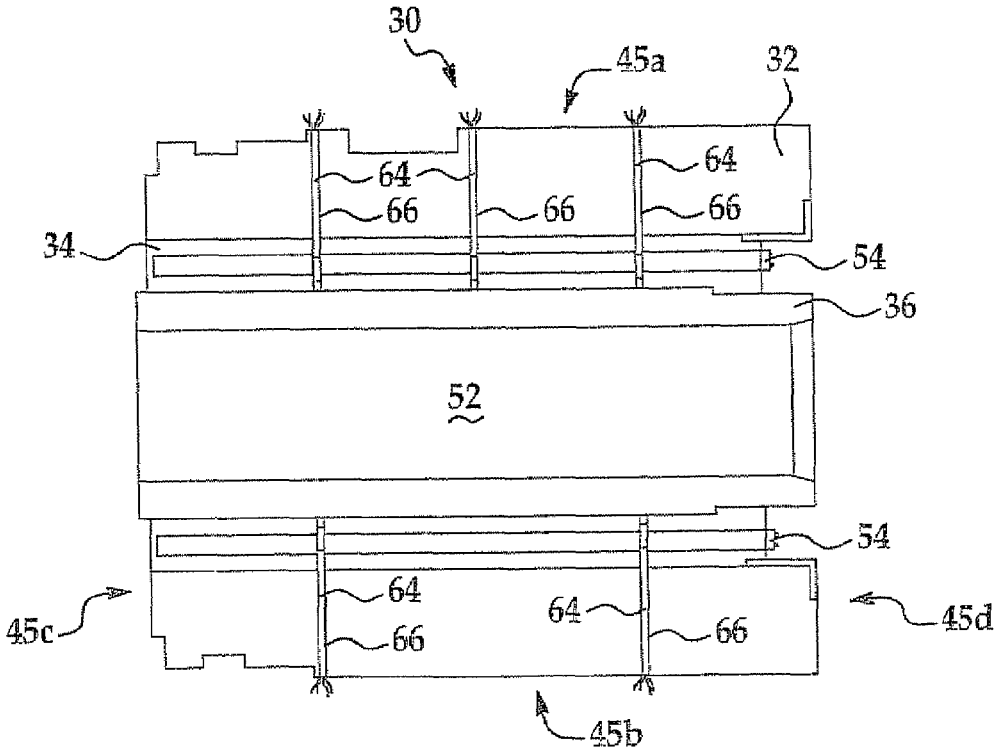
FIG. 4 is a side section view of the assembled container showing heating elements installed in the subliner.

As shown in FIGS. 2 and 3, the subliner 34 is configured with a plurality of longitudinal bores 50 around the central billet receiving bore 52. Within each longitudinal bore 50 is placed a heater element 54 or cartridge, as shown in FIG. 4. For exemplary purposes, the subliner 34 is shown with 12 longitudinal bores 50, but it can be appreciated that more or less may be implemented. The subliner 34 may be machined with longitudinal bores 50 that extend along its entire length, or just a portion thereof allowing for tailored placement of the heater elements 54 relative to the various zones of the container 30. The subliner 34 may also be machined with longitudinal bores 50 having sufficient clearance so as to allow extraction of the heating elements 54 in the event that the longitudinal bores 50 have undergone stress-induced deformation.

Figure 5:
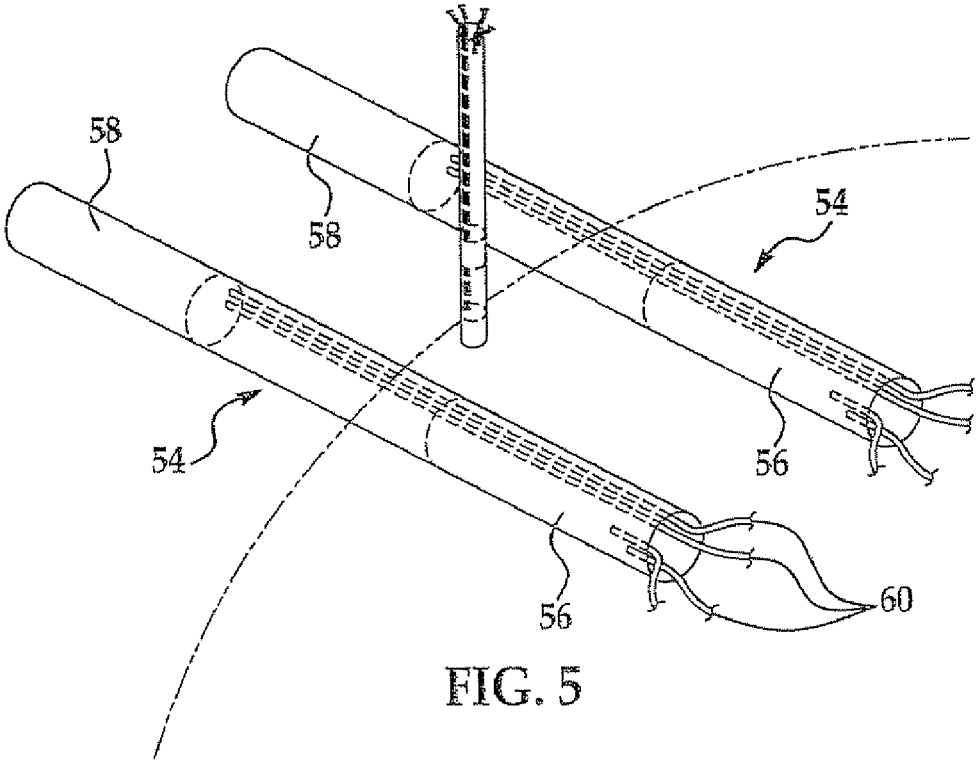
FIG. 5 is a perspective view of the heating elements suitable for the subliner of the present invention.
Figure 6A:
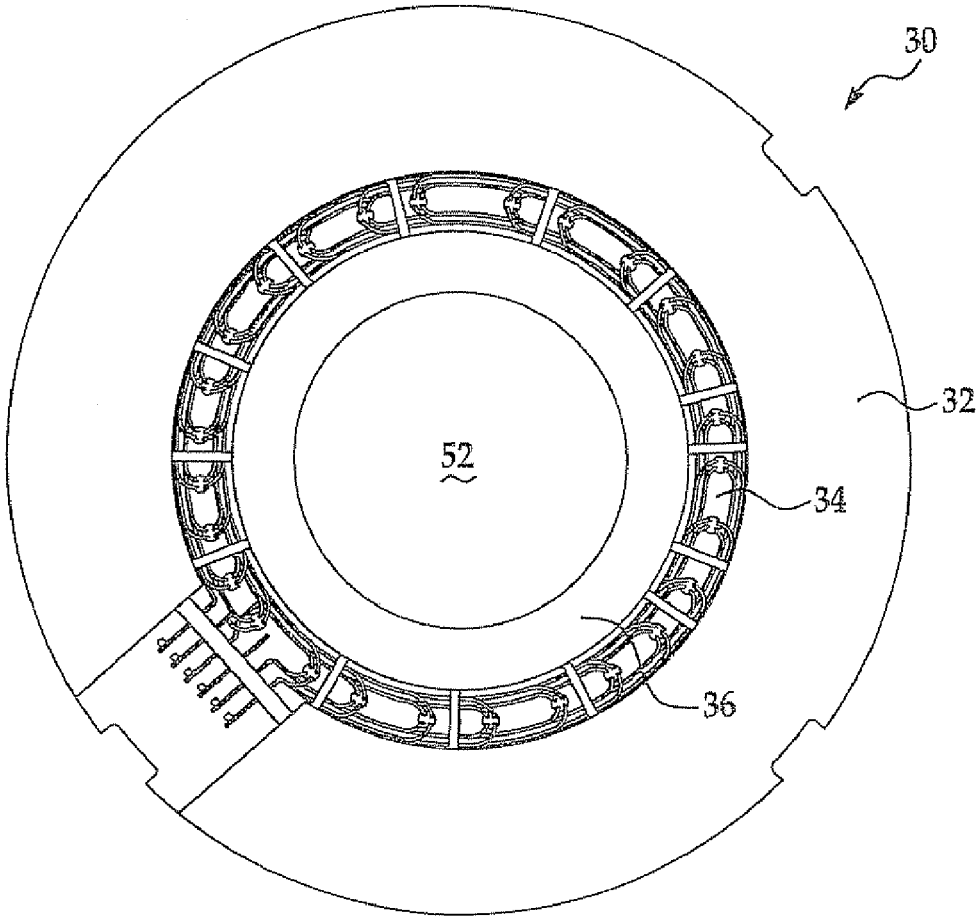
FIGS. 6*a* and 6*b* are views showing the bus lines on the container for connecting the heating elements.
Figure 6B:
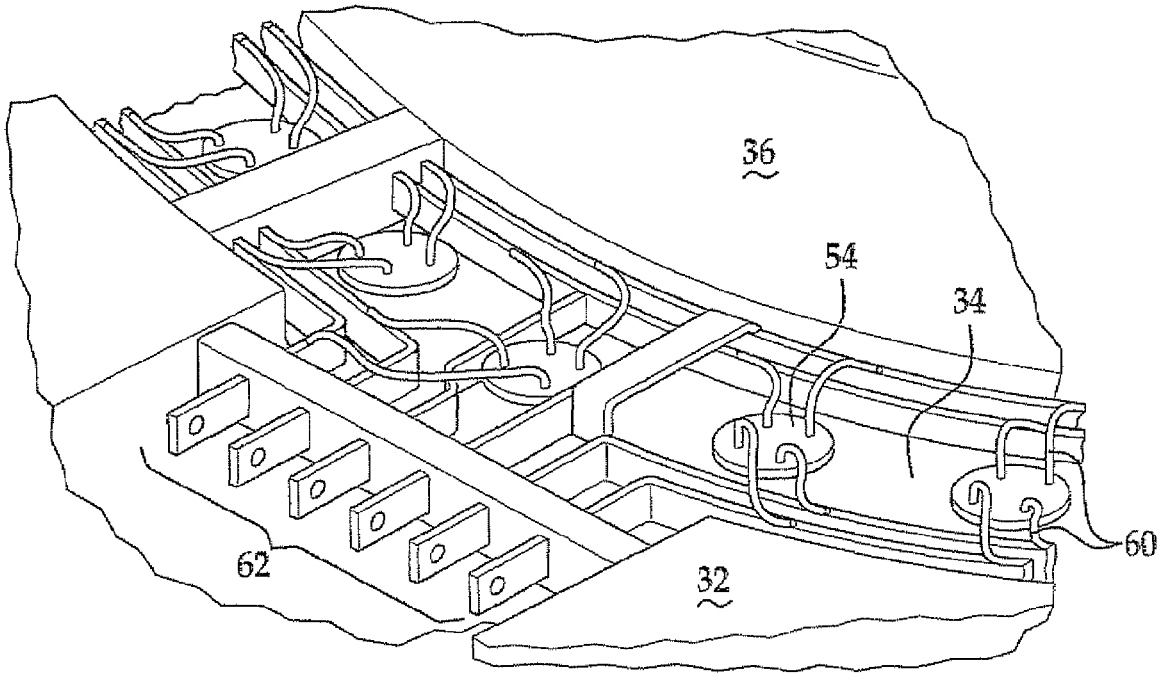

The heating elements 54 suitable for the subliner 34 of the present invention are cartridge-type elements, as shown in FIG. 5. As discussed in the background, the regions of the container in greatest need of added temperature are generally the front 45*c* and rear 45*d* areas, namely the die end 38 and ram end 40, respectively. As such, the heating element may be configured with segmented heating regions. In a preferred embodiment, and as shown in FIG. 5, the heating element is configured with a front heating section 56 and a rear heating section 58. It can be appreciated, however, that the heating cartridge may be configured with additional or fewer heating segments, or may alternatively be configured to heat along the entire length of the heating cartridge. To energize and control the heating elements, lead lines 60 feed to each heating section 56, 58. As shown in FIGS. 6*a* and 6*b*, the lead lines connect to various centralized bus lines 62, which in turn connect to a controller (not shown). The arrangement of the bus lines 62 may take any suitable configuration, depending on the heating requirements of the container 30. In a preferred embodiment, the bus lines are configured to selectively allow heating of the top zone 45*a*, bottom zone 45*b*, front zone 45*c* and rear zone 45*d* of the container, or more preferably just portions thereof, as deemed necessary by the operator. For example, the operator may routinely identify temperature deficiencies in the bottom zone 45*b*, particularly in the vicinity of the front zone 45*c* and rear zone 45*d*. As such, heating elements 54 having selectable front and rear heating sections would be used in the vicinity of the bottom zone 45*b* to provide added temperature when required. It can also be appreciated that an operator can selectively heat zones so as to maintain a preselected billet temperature profile. For example, an operator may choose a billet temperature profile in which the temperature of the billet progressively increases towards the die end, but with a constant temperature profile across the cross-sectional area of the billet. This configuration is generally referred to as a "tapered" profile. Having the ability to selectively heat zones where necessary enables the operator to tailor and maintain a preselected temperature profile, ensuring optimal productivity.

Figure 7:
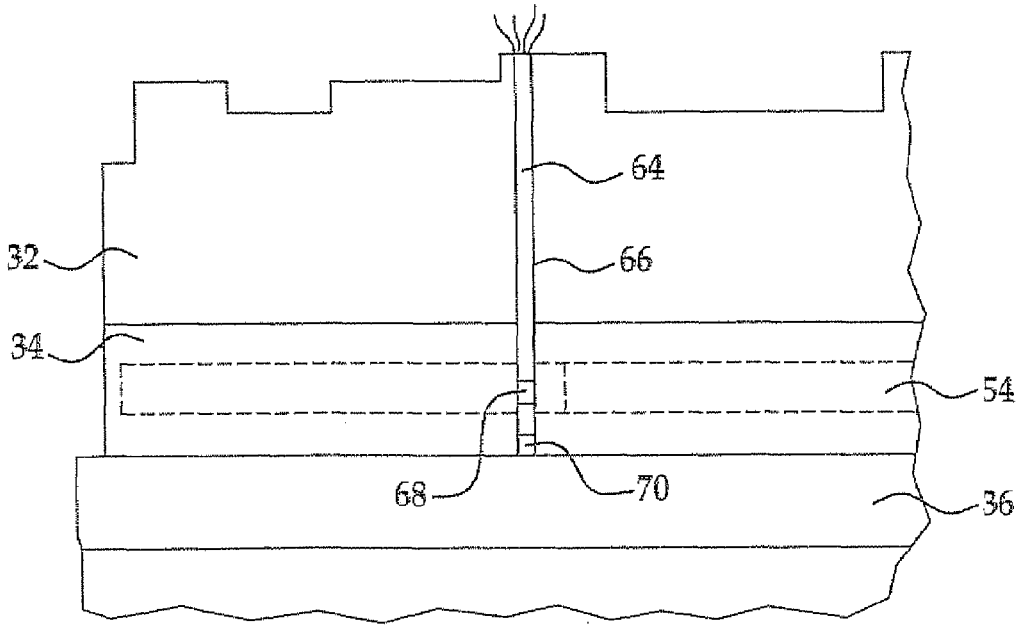
FIG. 7 is a close-up side sectional view of the assembled container showing a temperature sensor in position.

To monitor the temperature of the extrusion process, temperature sensors 64 (i.e. thermocouples) are used. As shown in FIG. 4, sensors 64 are preferably positioned in the top and bottom sections of the container 307 generally towards each end 38, 40. A further sensor 64 is preferably positioned in the top section towards the center. It can be appreciated, however, that one skilled in the art may choose to add additional sensors, or alter the placement so as to address a particular need. To allow placement of the sensors 64, the container 30 is configured with radially aligned boreholes 66 extending through the mantle 32 and subliner 34. In a preferred embodiment, each sensor 64 contains two sensing elements 68, 70, one sensing element 70 for placement adjacent the liner 36 for measuring liner temperature, the second sensing element 68 for placement in the vicinity of the heating elements housed in the longitudinal bores 50 of the subliner 34 (see FIG. 7). It can be appreciated that the boreholes 66 for housing the sensors 64 are aligned in a manner so as to avoid intersecting any of the heating element longitudinal boreholes 50. The sensors feed into a controller (not shown), providing the operator with temperature data from which subsequent temperature adjustments can be made.

In use, the subliner 34 makes it possible to closely monitor the temperature around the heating elements 54, and compare it with the temperature of the liner 36. It heats the liner 36 quickly, while preventing it from overheating. The possibility of the mantle 32 overheating, annealing and cracking is considerably reduced. The shrink-fit stress that secures the liner 36 remains stable, and thermal fatigue is minimized. The mantle 32 now simply supports the liner 36 and subliner 34, and acts as a heat sink, dissipating excess thermal energy from its surface.

The subliner 34 reacts quickly to changes in demand from heating. Since the heat source is immediately adjacent the liner 36, heating elements 54 may be positioned just in areas where heat is required. Only small amounts of thermal energy are therefore necessary to effectively control the temperature of the liner 36, and thus the flow of aluminum into the extrusion die. Once the extrusion process begins, thermal alignment can more easily be maintained. The subliner 34 also permits temperature control of the container 30 when the extrusion press is temporarily stopped. This alleviates the need for the remote heat sources previously used to maintain operating temperature at the liner 36.

The present invention offers a number of additional advantages to extrusion press technology. First, the incorporation of a high-strength steel sub-liner into the laminated construction of the assembled and shrunk-fit container results in a more robust design, thus aiding to maintain physical alignment of the extrusion press. Secondly, the subliner containing both temperature sensors and heating units can be factory wired, and delivered along with its controller to the extrude for local installation. It is not necessary to send the container to the supplier to have it installed.

Although a preferred embodiment of the present invention has been described, those of skill in the art will appreciate that variations and modifications may be made without departing from the spirit and scope thereof as defined by the appended claims.

What is claimed is:

1. A container for use in a metal extrusion press, said container having a billet receiving end and a billet exit end and comprising:

an elongate outer mantle;

an elongate, inner subliner received by said outer mantle, said inner subliner dimensioned to receive an inner liner through which a billet passes; and heating zones at different locations along said subliner, each of said heating zones comprising a plurality of longitudinally extending heating elements accommodated by said subliner with each heating element being positioned in close proximity to said inner liner.

2. The container of claim 1, wherein said elongate subliner is made from high-strength steel.

3. The container of claim 1, further comprising at least one temperature sensor accommodated by said subliner.

4. The container of claim 3, comprising a plurality of temperature sensors accommodated by said subliner.

5. The container of claim 3, wherein said at least one temperature sensor is a thermocouple.

6. The container of claim 1 wherein said heating zones provide progressively increasing temperature in a direction toward the billet exit end of said container.

7. The container of claim 6 wherein said heating zones further maintain a generally constant temperature profile across the cross-sectional area of a billet passing through said container.

8. The container of claim 6 wherein said heating elements are received by longitudinally extending, circumferentially spaced bores provided in said subliner.

9. The container of claim 8 wherein each heating element comprises a plurality of heating segments, at least one heating segment of said each heating element being positioned in each of said heating zones.

10. The container of claim 8 wherein each of said heating elements is a resistance-type heating element that provides conduction heat to said inner liner.

11. The container of claim 10 wherein each of said heating elements is formed as a cartridge inserted into a respective longitudinally extending bore provided in said subliner.

12. The container of claim 11 wherein each cartridge is electrically wired via the billet receiving end of said container.

13. The container of claim 6 further comprising a plurality of temperature sensors accommodated by said subliner.

14. The container of claim 1 wherein each of said heating elements is formed as a cartridge inserted into a respective longitudinally extending bore provided in said subliner.

15. The container of claim 14 wherein each cartridge is electrically wired via the billet receiving end of said container.

16. The container of claim 14 further comprising a plurality of temperature sensors accommodated by said subliner.

17. A container for use in an extrusion press for extruding an extrudable metal, said container comprising:

i) an outer mantle configured for connecting to an extrusion press and having a central axial bore therein;

ii) an inner liner; and iii) a subliner comprising an elongate annular body having an outer surface dimensioned for placement within the axial bore of said outer mantle, and an inner surface dimensioned to receive said inner liner, said subliner further comprising longitudinally extending heating elements positioned between said outer and inner surfaces at circumferentially spaced locations, said heating elements being in close proximity to said inner liner and being arranged into groups, said groups of heating elements defining independently controlled top, bottom, front and rear heating zones, said heating elements of the heating zones being energizable to heat said inner liner according to a desired heating profile.

18. The container of claim 17, wherein said elongate annular body of said subliner is constructed from high-strength steel.

19. The container of claim 17, further comprising at least one radially oriented temperature sensor accommodated by said subliner.

20. The container of claim 19, comprising a plurality of radially oriented temperature sensors accommodated by said subliner.

21. The container of claim 19, wherein said at least one temperature sensor is a thermocouple.

22. The container of claim 20, wherein each temperature sensor is accessible from the exterior of said outer mantle.

23. The container of claim 17 wherein said outer mantle, inner liner and subliner are shrunk fit with an interference of about 2% or less.

24. The container of claim 17 wherein each of said heating elements is a resistance-type heating element that provides conduction heat to said inner liner.

25. The container of claim 17 wherein each of said heating elements is formed as a cartridge inserted into a longitudinally extending bore provided in said subliner.

26. The container of claim 25 wherein each cartridge comprises selectable heating sections.

27. The container of claim 17 wherein said heating profile maintains a generally constant temperature across the cross-sectional area of extrudable metal inserted into said container thereby to provide a tapered profile.

28. The container of claim 27 further comprising a plurality of temperature sensors accommodated in radial bores provided in said subliner.

29. A container for use in a metal extrusion press, said container having a billet receiving end and a billet exit end and comprising:

an outer mantle;

an inner subliner received by said outer mantle, said inner subliner dimensioned to receive an inner liner through which a billet passes; and longitudinally extending heating elements accommodated by said subliner at circumferentially spaced locations, said heating elements being positioned in close proximity to said inner liner and being operative to heat said inner liner, wherein during heating said outer mantle remains cool relative to said inner liner.

30. The container of claim 29 wherein said heating elements provide progressively increasing temperature in a direction toward the billet exit end of said container.

31. The container of claim 30 wherein said heating elements further maintain a generally constant temperature profile across the cross-sectional area of a billet passing through said container.

32. The container of claim 29 wherein said heating elements are positioned adjacent at least the billet receiving end and the billet exit end of said container.

33. The container of claim 32 wherein said heating elements are received by longitudinally extending, circumferentially spaced bores provided in said subliner.

34. The container of claim 33 wherein each of said heating elements is a resistance-type heating element that provides conduction heat to said inner liner.

35. The container of claim 34 wherein each of said heating elements is formed as a cartridge inserted into a respective longitudinally extending bore in said subliner.

36. The container of claim 29 further comprising a plurality of temperature sensors accommodated by said subliner.

37. The container of claim 36 wherein each of said heating elements is a resistance-type heating element that provides conduction heat to said inner liner.

38. The container of claim 37 wherein each of said heating elements is formed as a cartridge inserted into a longitudinally extending bore provided in said subliner.

39. The container of claim 36 wherein each temperature sensor is accommodated by a radially extending bore formed in said subliner.

* * * * *